United States Patent [19]

Johnstonbaugh

[11] Patent Number: 4,625,477

[45] Date of Patent: Dec. 2, 1986

[54] DISPLAY WALL FORMED OF READILY ATTACHABLE AND DETACHABLE PANELS

[75] Inventor: George S. Johnstonbaugh, New Philadelphia, Ohio

[73] Assignee: Masonite Corporation, Chicago, Ill.

[21] Appl. No.: 808,765

[22] Filed: Dec. 13, 1985

[51] Int. Cl.[4] ..... E02D 35/00

[52] U.S. Cl. ..... 52/127.9; 52/36; 52/239; 52/584

[58] Field of Search ..... 52/36, 127.5–127.9, 52/238.1, 239, 281, 282, 287, 241, 243, 243.1, 584, 821, 822, 823, 582

[56] References Cited

U.S. PATENT DOCUMENTS

| | | | |
|---|---|---|---|
| 2,081,368 | 7/1935 | Pretot | 72/115 |
| 3,280,522 | 10/1966 | Palfey et al. | 52/584 X |
| 3,332,182 | 7/1967 | Mark | 52/584 X |
| 4,020,613 | 5/1977 | Reynolds et al. | 52/127.9 X |
| 4,223,500 | 9/1980 | Clark et al. | 52/127.9 X |
| 4,334,374 | 6/1982 | Spamer et al. | 52/239 X |
| 4,370,838 | 2/1983 | Vermillion | 52/36 |
| 4,434,900 | 3/1984 | Cook | 211/189 |
| 4,493,174 | 1/1985 | Arens | 52/243 |

FOREIGN PATENT DOCUMENTS

| | | | |
|---|---|---|---|
| 650810 | 10/1962 | Canada | 52/239 |

OTHER PUBLICATIONS

Brochure (2 Pages)-Hafele America (Giro-Bolt Lock) 1/84.

*Primary Examiner*—Carl D. Friedman
*Assistant Examiner*—Naoko N. Slack
*Attorney, Agent, or Firm*—Samuel Kurlandsky; Robert M. Didrick; Robert H. Robinson

[57] ABSTRACT

A modular wall panel construction including at least two vertically oriented structural members in edge-to-edge engagement, and means affixing the structural members together and permitting ready disassembly thereof, comprising a vertically oriented standard affixed to the edge of one structural member and having slots provided therein, and a plurality of rotary bolt locks mounted in the edge of the other structural member, the rotary bolt lock having an arcuate bolt engaging the slots of the vertical standard member, thereby locking the structural members together, and permitting easy disassembly thereto. In one embodiment of the invention some of the structural members comprise pilasters also having rotary bolt locks or vertical standards for assembly with the other structural members.

18 Claims, 17 Drawing Figures

DISPLAY WALL FORMED OF READILY ATTACHABLE AND DETACHABLE PANELS

BACKGROUND OF THE INVENTION

1. Field of the Invention

The present invention relates to a display wall structure which may be free-standing or anchored to a wall, and more particularly refers to a wall structure formed of individual panels which are readily attached and detached.

2. Description of the Prior Art

Vertical display walls are widely used in commercial establishments for the display of a wide variety of items. The display apparatus is universal and may be assembled to take a wide variety of shape and form configurations to accommodate a particular size and motif in a display area or showroom. The walls are generally formed of a plurality of panels which are adapted to be readily assembled and disassembled, and yet still provide a function and aesthetic appealing means for displaying a wide variety of articles. A wall of the type described is disclosed and claimed in U.S. Pat. No. 4,434,900. The edges of the individual panels are assembled to each other edge-wise by means of keyholes provided in the edge of one panel which engage screwheads provided in a post or another panel. Although this structure has been found adequate for many uses, it has the disadvantage that the panels or posts must be lifted in order for the screwheads to be engaged in the keyhole slots in an adjacent member.

SUMMARY OF THE INVENTION

It is accordingly an object of the present invention to provide a new and improved vertical display wall structure suitable for use in commercial establishment for the display of a wide variety of items, as well as for use as a wall structure generally.

It is a further object to provide a wall structure wherein a plurality of panels and posts may be relatively easily assembled and disassembled without the necessity for lifting the panel members and posts to engage and disengage the locking structures.

These and other objects, advantages and functions of the invention will be apparent upon reference to the specification and attached drawings illustrating preferred embodiments of the invention, in which like parts are identified by like reference symbols in each of the views.

According to the invention, a wall structure is provided comprised of a plurality of wall panels and metal standards or posts which are easily connected to each other by means of rotary latches retained in mortises provided in the edges of the panel members adapted to engage slots provided in metal standards or post structures or other panel edges. The structures are engaged by sliding them together without necessarily lifting any of them, inserting a key in an aperture of the latch mechanism, and rotating the key until an arcuate latch member engages slots provided in the standard of an adjacent member and latches the two members together. The latching structure has the advantage that it is recessed within the edges of the panels and therefore does not detract from the aesthetic appearance of the panels. Moreover, the latches may be readily engaged and disengaged by a simple rotation of the key inserted in the key aperture provided in the latch and in the panel.

DESCRIPTION OF THE PREFERRED EMBODIMENTS

Figure 1:
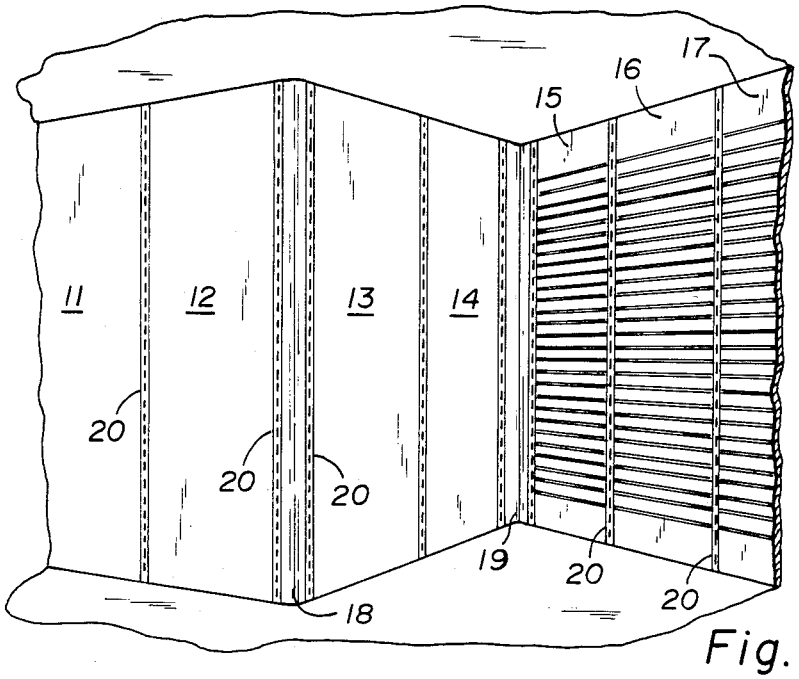
FIG. 1 is a perspective view of a modular wall structure according to the invention, assembled from a plurality of wall panels, pilasters and standards.
Figure 2:
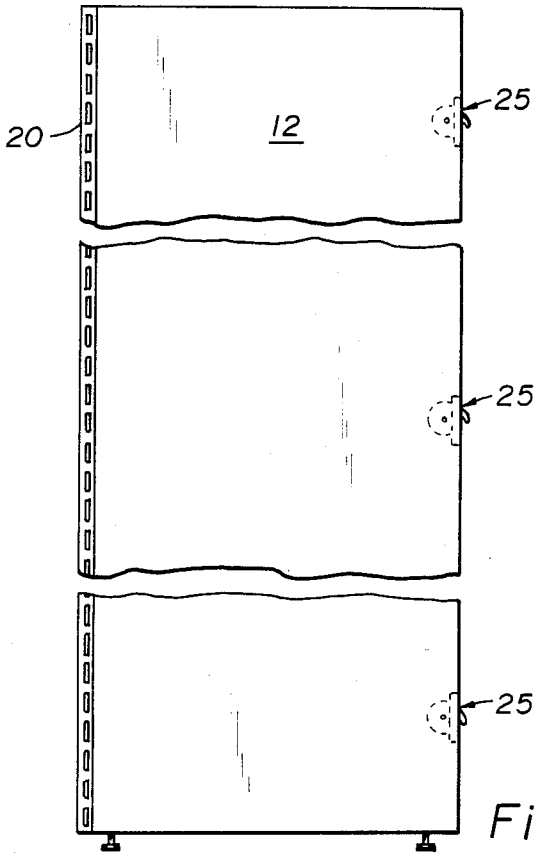
FIG. 2 is an elevational view of a single wall panel.
Figure 3:
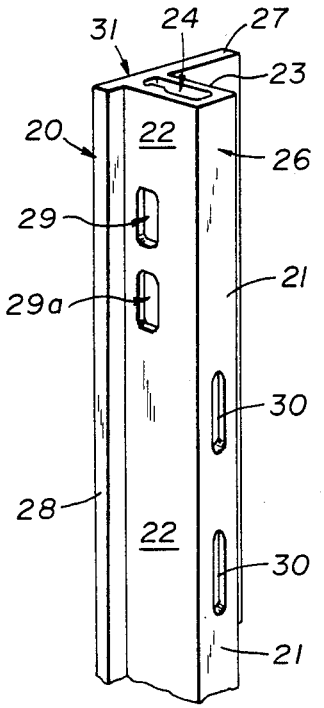
FIG. 3 is a perspective fragmentary view of a vertical standard according to the invention.

Referring to FIG. 1, a modular wall panel construction 10 is shown comprising a plurality of smooth wall panels 11, 12, 13 and 14, and display panels 15, 16 and 17 having horizontal grooves for mounting display brackets. The corners of the modular construction are formed by angular pilasters 18 and 19. Each joint is formed by a standard 20 co-operating with bolt locks mounted in mortised recesses at the edges of the complementary mating structure. The standards 20 are preferably formed of a metal such as steel or aluminum, but may be formed of other suitable strong materials such as various plastic materials.

Figure 4:
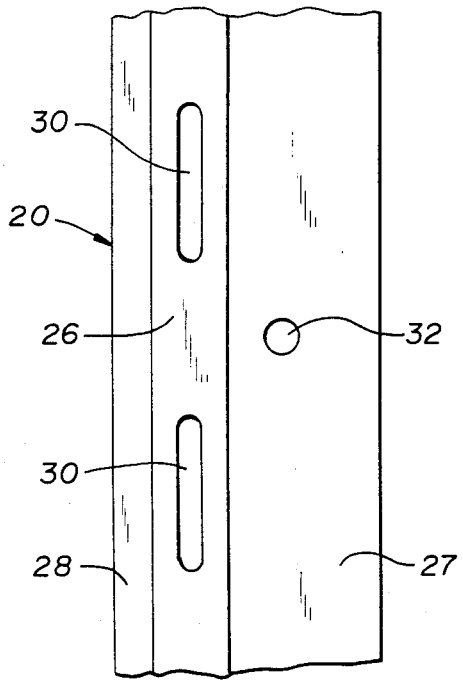
FIG. 4 is a fragmentary front view of the standard shown in FIG. 3.
Figure 5:
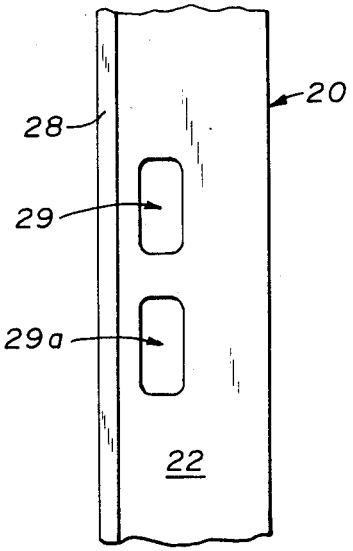
FIG. 5 is a left-edge view of the standard.
Figure 6:
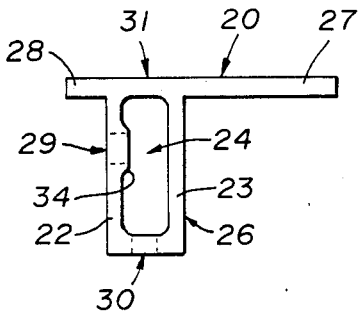
FIG. 6 is an end view of a standard as shown in FIGS. 3–5.

Referring to FIGS. 3, 4, 5, and 6, a standard 20 is shown comprising a tubular portion 26 formed of a rear plate 31 terminating in an attachment flange 27 on one side, and a guide flange 28 which is smaller than the attachment flange. The remainder of the tubular body portion 26 is formed of a front wall 21 and sidewalls 22 and 23. The structure defines a central channel 24. The sidewall 22 is provided with pairs of slots 29 at each position complementary with the position on the adjoining structural member containing bolt locks 25 mortised therein. The front wall 21 may be provided with slots 30 for receiving mounting brackets for supporting shelving or display articles. As shown in FIG. 4 apertures 32 are provided in the attachment flange 27 to receive screws 33 for affixing the metal standards 20 to the wall panels 12 and pilasters. FIG. 6 illustrates the presence of a fillet 34 in the sidewall 22 where the slots 29 are placed in order to provide reinforcement for engaging the latch of the bolt lock 25.

Figure 7:
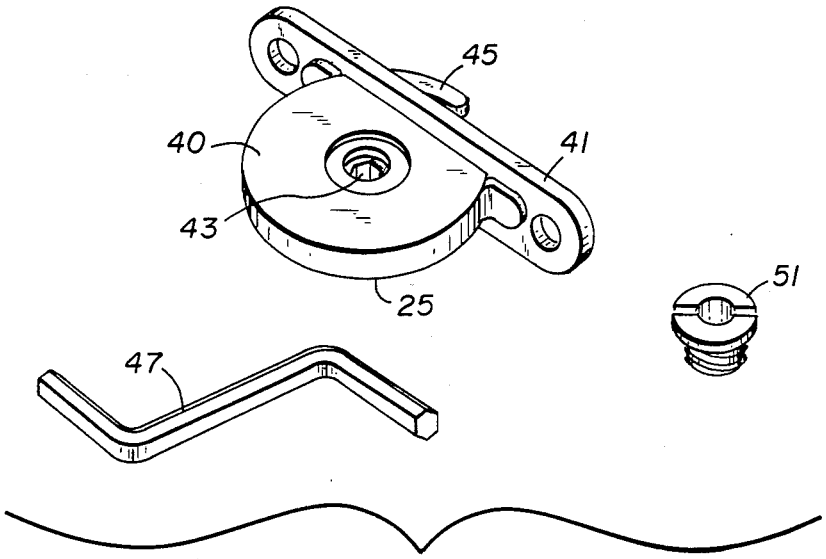
FIG. 7 is a perspective view of a lock assembly according to the invention.
Figure 8:
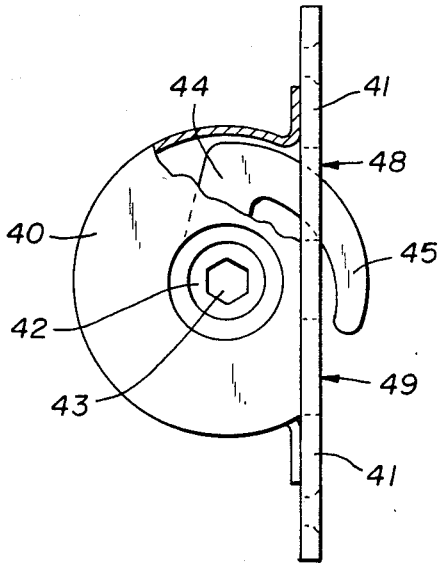
FIG. 8 is an elevational view of the locking mechanism shown in FIG. 7.

Referring to FIGS. 7 and 8, a bolt lock 25 assembly is shown, the bolt lock 25 generally being known in the trade as a GIRO-bolt lock marketed by the Hafele America Company, High Point, N.C. As shown in FIGS. 7 and 8, the structure includes a housing 40 having a mounting bracket 41 affixed thereto. A rotatable hub 42 is mounted in the housing and is provided with a hexagonal aperture 43. A radial arm 44, shown in FIG. 8, is connected to the hub 42 at one end and at the other having an arcuate bolt 45 extending through an aperture 48, and adapted, upon rotation of the hub 42, to enter a second aperture 49 provided in the mounting plate 41. The assembly additionally includes an Allen crank wrench 47 having a hexagonal cross-section adapted to be inserted into the hexagonal aperture 43 of the hub 42.

Figure 9:
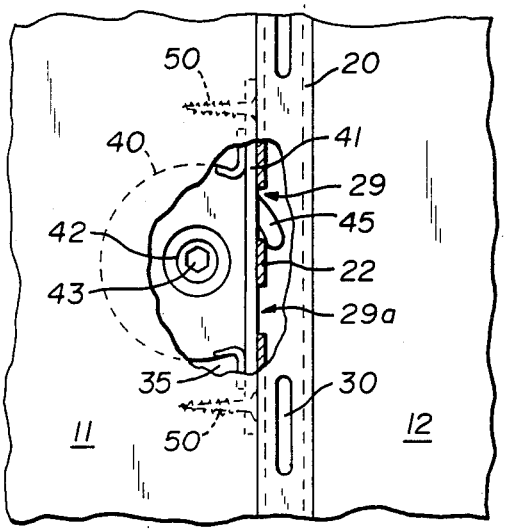
FIG. 9 is an elevational view, partly broken away, of a joint between two wall panels with the bolt in unlocked position.
Figure 10:
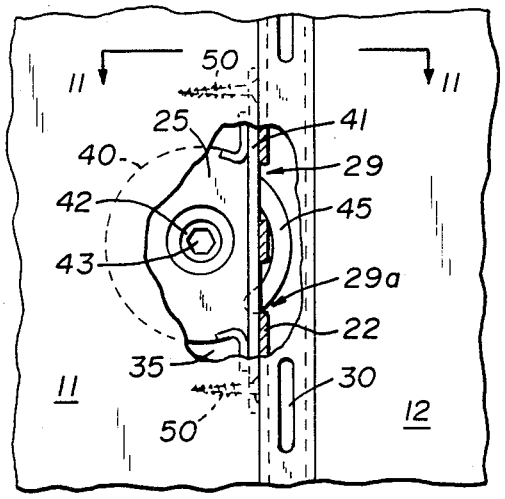
FIG. 10 is an elevational view, partly broken away, of the structure shown in FIG. 9 with the bolt in locked position.
Figure 11:
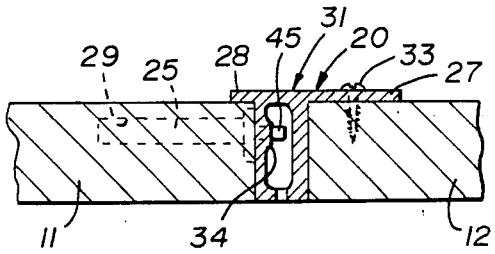
FIG. 11 is a cross-sectional view of a joint between two wall panels.

Referring to FIGS. 9, 10 and 11, a pair of wall panels 11 and 12 are shown. The wall panel 12 has a metal standard 20 affixed thereto by means of screws 33 inserted through apertures 32. The wall panel 11 has a plurality of mortised recesses 35 provided therein in which are mounted rotary bolt locks 25 affixed to the wall panel 11 by screws 50. As shown in FIG. 9, the hub 42 has been rotated by inserting the crankshaped Allen wrench 47 into the hexagonal aperture 43 and turning the crank until the arcuate bolt 45 has just entered the first slot 29 of the metal standard 20.

FIG. 10 shows the assembly after the crank has been further rotated and the arcuate bolt 45 has penetrated and emerged from the second slot **29*a* of the pair of slots of the metal standard 20. In this condition the two walls are firmly locked together and cannot be pulled apart. The locked condition is further shown in FIG. 11**.

The modular wall panel construction of the present invention is extremely versatile. Joints may be formed between two doors, between two wall panels of many different styles such as decorative wall panels and display-type wall panels which have grooves provided therein for mounting brackets to sustain displays and shelves. In order to form a joint, it is only necessary that one structural member has a standard according to the invention affixed thereto by means of screws or other suitable fastening means, and the other structural member must have mortises provided in a plurality of positions in which rotary bolt locks are inserted and affixed. In order to connect two structural members together, they need only be made to slide together, and the crank inserted into the hexagonal apertures of the locks and rotated until the arcuate bolt 45 enters the first slot 29 of each standard, the crank being further rotated until the bolt end returns and enters and emerges from the second slot **29*a*** of the standard. In this condition the two structures are locked together and cannot be pulled apart. For connecting structural members such as wall panels it is desirable to have at least one rotary bolt lock provided for each 3 feet of structural edge, and an equal number of pairs of slots provided in the standard of the other structural member for each rotary bolt lock used in the first structural member. In connecting two structural members such as two wall panels together, it is only necessary to slide the two panels together until their edges meet, and then rotate the hub of each rotary bolt lock until the arcuate bolt of each lock engages the slots of the metal standard. The two structures are then firmly locked together and cannot be pulled apart.

Figure 12:
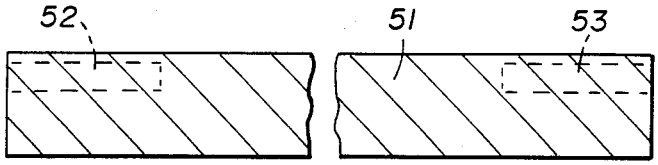
FIG. 12 is a cross-sectional view of a wall panel being mortised at both edges to receive a bolt lock.

In order to assembly a plurality of wall panels, each panel may be provided with one metal standard at one edge and a plurality of rotary bolt locks at the other edge, as shown and described in FIGS. 9–11. Alternatively, as shown in FIG. 12, a wall panel 51 may be provided having mortises 52 and 53 in which rotary bolt locks 25 according to the invention may be provided at both edges. The panel may then be connected at both ends to structural members having standards.

Figure 13:
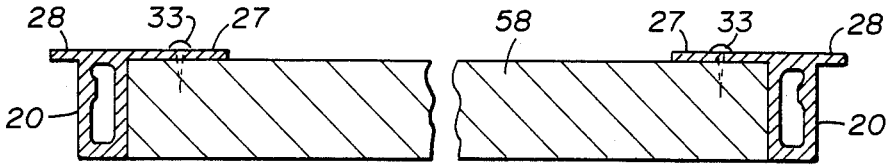
FIG. 13 is a fragmentary cross-sectional view of a wall panel having a standard at both edges.

FIG. 13 shows a wall panel 58 having standards 20 mounted one at each edge. Each edge may be then mounted to another structural member which has a plurality of rotary bolt locks 25 mounted therein.

The modular wall panel construction of the present invention may be affixed by means of suitable brackets to a permanent wall structure, or, alternatively, may be free-standing. In order for the structure to be free-standing, some of the wall panels must be oriented at an angle with respect to the others. In order to provide for this, the present invention includes structural members in the form of pilasters or posts. The pilasters may be provided with any desired angular shape, and may have either standards or rotary bolt locks at its edges.

Figure 14:
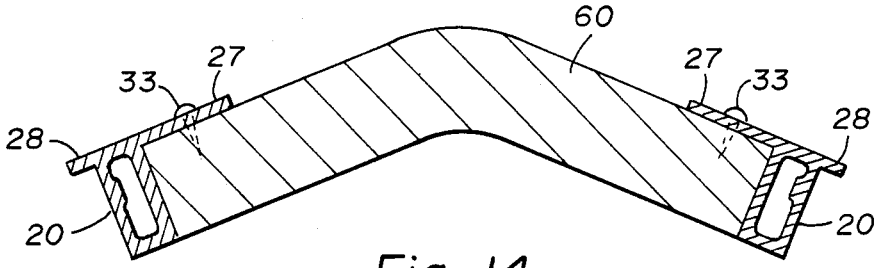
FIG. 14 is a pilaster in the form of an obtuse angle having a standard at both edges.

In FIG. 14 is shown a pilaster 60 whose legs are at an obtuse angle with respect to each other. Affixed to the ends of the pilaster are a pair of standards 20. Alternatively, a plurality of rotary bolt locks 25 may be substituted at one or both edges.

Figure 15:
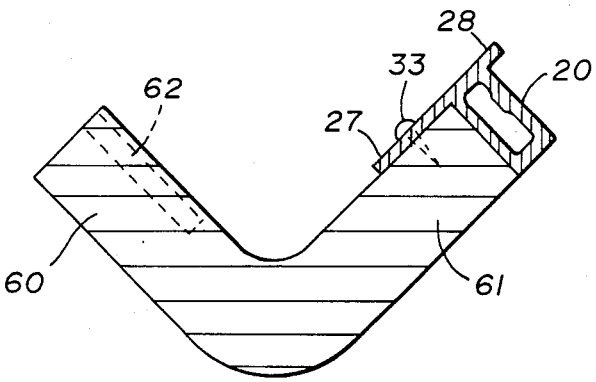
FIG. 15 is a cross-sectional view of a pilaster in the form of a right angle having a mortise at one edge and a standard at the other edge.

In FIG. 15 is shown a pilaster 61 in the form of a right angle. Here a plurality of mortises 62 are provided at one edge adapted to receive a plurality of rotary bolt locks 25. A standard 20 is affixed to the other edge. Wall panels may then be affixed to the edges of the pilaster by means of complementary locking means. Since the walls affixed to the pilaster 61 will be at right angles, the structure will be free-standing.

Figure 16:
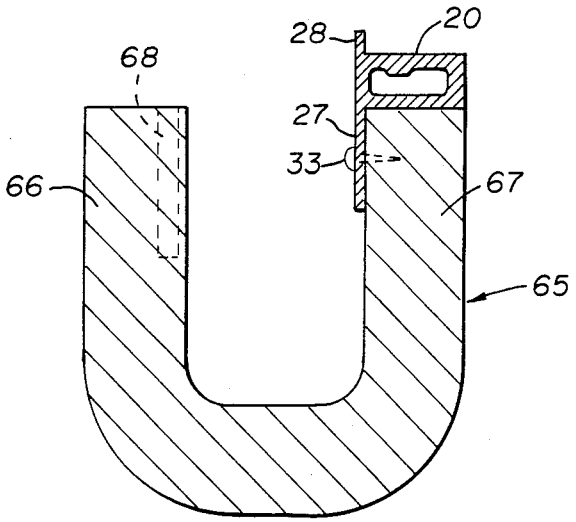
FIG. 16 is a pilaster of U-shaped cross-section having a mortise at one edge and a standard at the other.

Referring to FIG. 16 a pilaster 65 is shown having a U-shaped cross-section. The structure comprises legs 66 and 67, one having a mortise 68 provided to receive a bolt lock 25 and the other being provided with a metal standard 20 adapted to be attached to wall panels having bolt locks 25.

Figure 17:
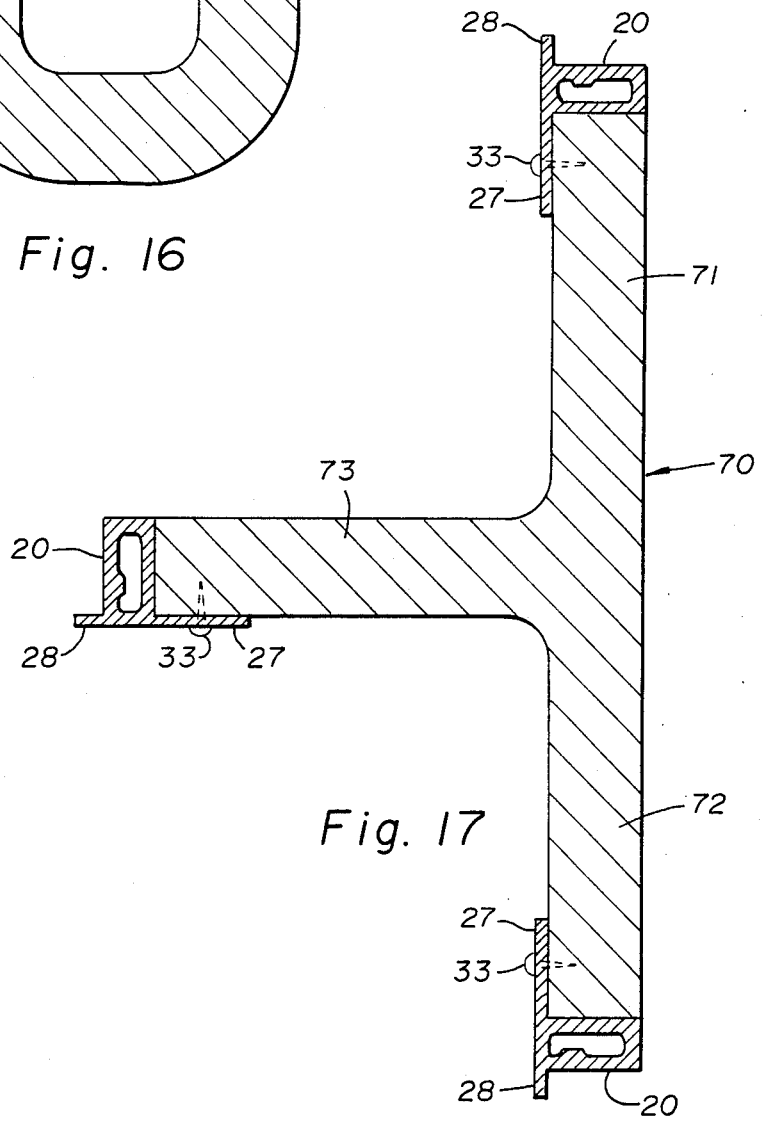
FIG. 17 is a cross-sectional view of a pilaster having a T-shaped cross-section with a standard mounted at each edge.

Referring to FIG. 17, a pilaster 70 is shown having a T-shaped cross-section comprised of legs 71, 72 and 73. Metal standards 20 are provided at the end of each leg for being connected to wall panels having bolt locks.

The modular wall panel instruction of the present invention has a number of advantages over the structures of the prior art. First, in contrast to the case of fastening means such as keyholes and bolts, the panels of the present structure need not be lifted in order to engage their edges. It is only necessary to slide the panels together until their edges are in engagement. Then the Allen wrench crank is inserted in the hex apertures of the bolt locks and turned until the bolts engage the slots of the metal standard of the adjoining structural member. Once the bolts are engaged, the structural members cannot be pulled apart, but can only be released by rotating the bolts in the opposite direction. Many different types of panels may be affixed together. The structure may be made free-standing by utilizing a pilaster to connect the wall panels at an angle. Wall panels may be connected to wall panels and wall panels may be connected to pilasters. It is only necessary that the engaging edge of one structural member be provided with a metal standard having appropriately placed pairs of engagement slots, notches that and the edge of the other structural member be provided with a plurality of bolt locks at positions where they may engage the slots of the metal standard. A simple rotation of the Allen wrench crank will then firmly lock the members together. The bolt locks are commercially made and may be readily obtained in the market. The metal standard may be readily extruded from a material such as aluminum or even a strong plastic material, and then machined to provide the proper engagement slots. Modular structures may then be sssembled such as the one shown in FIG. 1.

It is to be understood that the invention is not to be limited to the exact details of construction or operation or materials shown and described, as obvious modifications and equilvalents will be apparent to those skilled in the art.

Invention is claimed as follows:

1. A modular wall panel construction including at least two vertically oriented structural members in edge-to-edge engagement, and means affixing said structural members together and permitting ready disassembly thereof, said means comprising a plurality of recesses provided in an edge of a first one of said structural members and a rotary bolt lock affixed within each recess, and a vertical standard affixed at an edge of the second one of said structural members, A. each of said rotary bolt locks comprising:

(1) a housing having an opening at an edge thereof, (2) a hub rotatably mounted in said housing and having an aperture provided therein adapted to receive a driving means, (3) a radial arm affixed to said hub, (4) an arcuate bolt extending from an end of said radial arm, and (5) driving means adapted to be inserted in the aperture of said hub, and, upon rotation, to cause said radial arm to revolve, thereby causing said arcuate bolt to emerge from the aperture in said housing, and B. said elongate standard comprising:

(1) means for affixing said standard to the second of said structural members comprising a mounting flange engaging a face of the second of said structural members and having apertures provided in said flange and affixing means extending through said apertures and engaged in said second structural member, (2) said standard having a wall substantially perpendicular to said mounting flange and being provided with a plurality of pairs of slots, one pair of slots being juxtaposed opposite each of said rotary bolt locks of said first structural members, whereby, when said two structural members at each joint are brought together edge-to-edge and said drive means is inserted in the aperture of said hub and rotated, the arcuate bolt of said rotary bolt lock emerges from the aperature of said housing, enters one slot of one of said pairs of slots in said standard and returns through the second slot of said pair of slots, thereby solidly affixing said two structural members together.

2. A modular wall panel construction according to claim 1, wherein said elongate standard has a rectangular tubular cross-section comprising a rear wall extending in one direction to form said mounting flange affixing said standard to said second structural member and extending in the other direction to form a guiding flange for guiding said first structural member into juxtaposition with said standard, said standard additionally comprising a pair of sidewalls one of which is provided with said pairs of slots for receiving the arcuate bolts of said bolt locks, and a front wall.

3. A modular wall panel construction according to claim 2, wherein said vertical standard is formed of metal.

4. A modular wall panel construction according to claim 3, wherein a plurality of slots are provided in the front wall of said standard for mounting display brackets thereon.

5. A modular wall panel construction according to claim 1, wherein said structural members comprise two adjoining wall panels.

6. A modular wall panel construction according to claim 1, wherein said structural members comprise one panel and one adjoining pilaster.

7. A modular wall panel construction according to claim 6, wherein said pilaster is comprised of two members disposed at a right angle to each other.

8. A modular wall panel according to claim 6, wherein said pilaster is comprised of two members disposed at an obtuse angle with respect to each other.

9. A modular wall panel construction according to claim 1, wherein the driving means for said rotary bolt locks comprises a crank having a hexagonal cross-section and the aperture of said hub has a hexagonal cross-section adapted to receive and engage the end of said crank.

10. A free-standing modular wall panel construction comprising a plurality of vertically oriented structural members in edge-to-edge engagement including a plurality of wall panels and at least one pilaster formed of two members disposed at an angle with respect to each other, and means at the joint of each pair of structural members affixing said members together and permitting ready disassembly thereof, said means comprising a plurality of recesses having a rotary bolt lock affixed in each one at an edge of a first one of said structural members at each joint, and a vertical standard affixed at an edge of the second one of said structural members, A. each of said rotary bolt locks comprising:

(1) a housing having an aperture at an edge thereof, (2) a hub rotatably mounted in said housing and having an aperture provided therein adapted to receive a driving means, (3) a radial arm affixed to said hub, (4) an arcuate bolt extending from an end of said radial arm, and (5) driving means adapted to be inserted in the aperture of said hub, and, upon rotation, to cause said radial arm to revolve thereby causing said arcuate bolt to emerge from the aperture in said housing, and B. an elongate standard comprising:

(1) means for affixing said standard to the second of said structural rembers comprising a mounting flange engaging a face of the second of said structural members and having apertures provided in said flange and affixing means extending through said apertures and engaged in said second structural member, (2) said standard having a wall substantially perpendicular to said mounting flange and being provided with a plurality of pairs of slots, one pair of slots being juxtaposed opposite each of said rotary bolt locks of said first structural members, whereby, when said two structural members at each joint are brought together edge-to-edge, and said drive means inserted in the aperture of said hub and rotated, the arcuate bolt of said rotary bolt lock emerges from the aperture of said housing, enters one slot of one of said pairs of slots in said standard bracket, and returns through the second slot of said pair of slots, thereby solidly affixing said two structural members together.

11. A free-standing modular wall panel construction according to claim 10, wherein said elongate standard has a rectangular tubular cross-section comprising a rear wall extending in one direction to form said mounting flange affixing said standard to said second structural member and extending in the other direction to form a guiding flange for guiding said first structural member into juxtaposition with said standard, said standard additionally comprising a pair of sidewalls one of which is provided with said pairs of slots for receiving the arcuate bolts of said bolt locks, and a front wall.

12. A free-standing modular wall panel construction according to claim 11, wherein said vertical standard is formed of metal.

13. A modular wall panel construction according to claim 12, wherein a plurality of slots are provided in the front wall of said standard for mounting display brackets thereon.

14. A modular wall panel construction according to claim 10, wherein said structural members comprise two adjoining wall panels.

15. A modular wall panel construction according to claim 10, wherein said structural members comprise at lease one panel and one pilaster.

16. A modular wall panel construction according to claim 15, wherein said pilaster is comprised of two members disposed at a right angle to each other.

17. A modular wall panel according to claim 15, wherein said pilaster is comprised of two members disposed at an obtuse angle with respect to each other.

18. A modular wall panel construction according to claim 10, wherein the driving means for said rotary bolt locks comprises a crank having a hexagonal cross-section and the aperture of said hub has a hexagonal cross-section adapted to receive and engage the end of said crank.

* * * * *